US005518184A

United States Patent [19]

Potz et al.

[11] Patent Number: 5,518,184

[45] Date of Patent: May 21, 1996

[54] FUEL INJECTION NOZZLE FOR INTERNAL COMBUSTION ENGINES

[75] Inventors: Detlev Potz, Stuttgart; Guenther Lewentz, Hemmingen; Uwe Gordon, Markgroeningen, all of Germany

[73] Assignee: Robert Bosch GmbH, Stuttgart, Germany

[21] Appl. No.: 309,696

[22] Filed: Sep. 21, 1994

[30] Foreign Application Priority Data

Sep. 22, 1993 [DE] Germany ..... 43 32 124.0

[51] Int. Cl.[6] ..... F02M 61/16; F02M 51/06

[52] U.S. Cl. ..... 239/533.4

[58] Field of Search ..... 239/533.4, 533.8, 239/533.9, 585.1, 454, 456, 453

[56] References Cited

U.S. PATENT DOCUMENTS

| | | | |
|---|---|---|---|
| 4,187,987 | 2/1980 | Raue | 239/533.4 |
| 4,619,400 | 10/1986 | van der Burgt | 239/456 X |
| 4,909,444 | 3/1990 | Sczomak | 239/533.4 X |
| 5,048,489 | 9/1991 | Fischer et al. | 123/467 |

FOREIGN PATENT DOCUMENTS

| | | | |
|---|---|---|---|
| 0246373 | 11/1987 | European Pat. Off. . | |
| 0460381 | 12/1991 | European Pat. Off. . | |
| 3627325 | 2/1987 | Germany | 239/456 |
| 1399757 | 7/1975 | United Kingdom . | |
| 2152135 | 7/1985 | United Kingdom . | |
| 2165308 | 4/1986 | United Kingdom . | |
| 2219828 | 12/1989 | United Kingdom | 239/533.12 |

*Primary Examiner*—Kevin P. Weldon

*Attorney, Agent, or Firm*—Edwin E. Greigg; Ronald E. Greigg

[57] ABSTRACT

A fuel injection nozzle having an outwardly opening valve member, which is acted on in an opening direction by fuel pressure and in a closing direction by a closing spring. In order to control the opening characteristic curve of a stroke-dependently cleared injection cross section, an electrical actuator in the form of a piezo-electric stack or a magneto-strictive final control member is disposed in the nozzle holder, which actuator carries a collar on the valve member. The reciprocating motion of the valve member is limited in controlled fashion by shortening the length of the actuator.

6 Claims, 1 Drawing Sheet

FUEL INJECTION NOZZLE FOR INTERNAL COMBUSTION ENGINES

BACKGROUND OF THE INVENTION

The invention is based on a fuel injection nozzle for internal combustion engines, particularly diesel engines, as defined hereinafter. An injection nozzle of this kind, known for example from DE-A-35 33 085, has as its actuator a piezo-electric stack whose elongation is transmitted, upon application of an excitation voltage, to the valve needle, which controls a metering opening and determines the length of the stroke of the needle counter to the force of the closing spring.

OBJECT AND SUMMARY OF THE INVENTION

The fuel injection nozzle according to the invention has the advantage that the opening motion of the valve member, as is usual in this field, is occasioned by the hydraulic pressure of the fuel, and that the precise adaptation of the injection cross section that is cleared with each opening stroke is effected by the very exact and fastworking actuator. Since actuators, such as piezo-electric stacks and magnetostrictive final control elements, of limited size execute only short adjusting paths, it is advantageous to control only the second part of the opening stroke of the valve member with the actuator. Advantageous features of and improvements to the fuel injection nozzle recited hereinafter are possible by means of the provisions recited herein.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
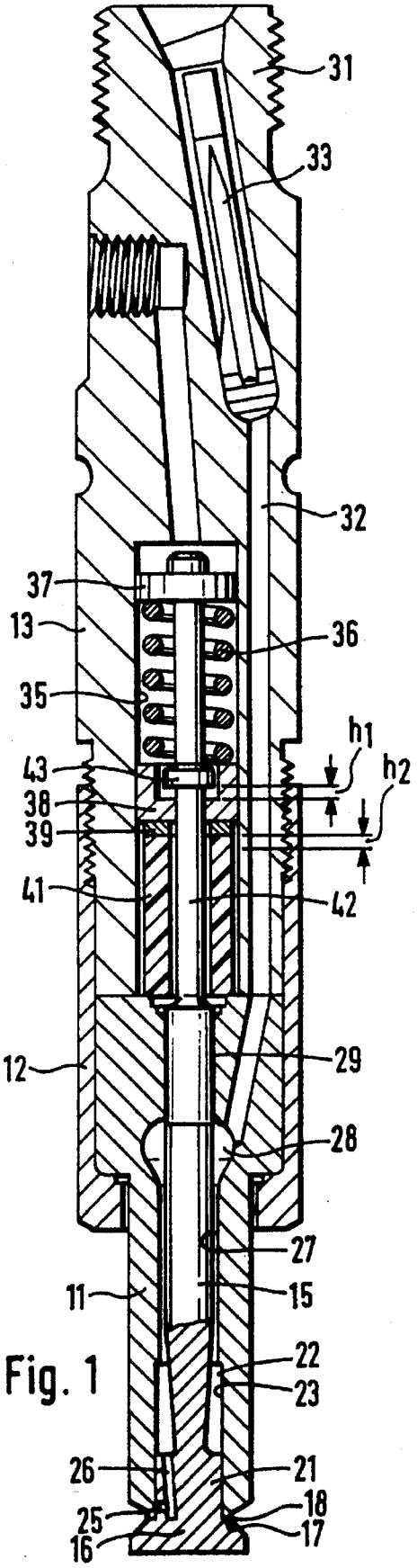
FIGS. 1 and 2 show longitudinal sections through two exemplary embodiments of a fuel injection nozzle according to the invention.

Both exemplary embodiments of the fuel injection nozzle have a nozzle body 11, which is tightly secured to a nozzle holder 13 by means of a union nut. A valve member 15, which carries a closing head 16 on the combustion chamber end, is supported in the nozzle body 11 so that it can be moved longitudinally. This closing head 16 has a truncated closing cone 17 that cooperates with a conical valve seat 18 on the combustion chamber end of the nozzle body 11. Radially offset from the valve cone 17, the closing head 16 has a piston 21, which is guided in a cylinder bore 23 in the nozzle body 11, which constitutes a pressure chamber 22. At least one injection port 25 in the jacket of the piston 21 discharges above the closing cone 17; it begins at a supply bore 26 and its axis runs slightly oblique to the radial. In the closing position of the valve member 15, which opens outward, that is, when the closing cone 17 of the valve member 15 sealingly contacts the valve seat 18 of the nozzle body 11, the mouth of the injection port 25 is covered by the wall of the cylinder bore 23 of the nozzle body 11. Upon displacement of the valve member 15 to open the valve, the valve cone 17 lifts from the valve seat 18 and, depending on the stroke of the valve member 15, the opening cross section of the injection port 25 is increasingly cleared, to inject a metered amount of fuel from a control edge at the transition from the cylinder bore 23 to the valve seat 18.

The valve member 15 passes through the nozzle body 11; an annular gap 27 and a collecting chamber 28, and above them a guide section 29 for the shaft of the valve member 15, adjoin the pressure chamber 22. An inlet conduit 32 leads from a connection fitting 31 on the nozzle holder 13 to the collecting chamber 28 via a filter 33.

A closing spring 36 is disposed in the bore 35 of the nozzle holder 13 that opens against the nozzle body 11; this spring 36 engages the end of the valve member 15 remote from the closing head 16 via a support disk 37 and urges the valve member 15 in the closing direction. The closing spring 36 is supported on an actuator 41 via a support ring 38 and a compensating disk 39; the actuator 41 rests axially with its other end on the nozzle body 11. The actuator 41 takes the form of a hollow cylinder, through which the section 42 of the nozzle member 15 which is offset in the diameter and which protrudes into the blind bore 35 extends. Above the support ring 38, on its section 42, the nozzle member 15 has a collar 43, which in the closing position of the nozzle member 15 is spaced apart from the support ring 38 by a distance $h_1$ in the range from 0.0 to 0.03 mm.

The actuator 41 is preferably an electric final control element in the form of a piezo-electric stack, which when triggered becomes shorter as a function of the magnitude of the control voltage. A magnetostrictive final control element can also be disposed as the actuator.

The fuel injection nozzle shown in FIG. 1 functions as follows: In the closing positions the closing spring 36 presses the valve member 15, having the closing cone 17 on the closing head 16, against the valve seat 18 on the nozzle body 11. Upon delivery of fuel through the inlet conduit 32, the collecting chamber 28, and the annular gap 27 into the pressure chamber 22, and when pressure builds up in the chamber 22, the valve member 15 is slid outward to open, by imposition of pressure on its piston 21 counter to the force of the closing spring 36. During a first movement phase, in which the valve member 15, by means of pressure acting upon it, is moved by a distance $h_1$, to the point where the collar 43 comes into contact with the support ring 38, a part of the injection cross section of the injection port 25 is initially cleared progressively by the control edge of the nozzle body 15. Electric triggering causes the actuator 41 to become shorter, depending on the controlled voltage variable; in a second controlled part of the stroke, the valve member 15, with its collar 43, slides the support ring 38 and the compensating disk 39, which are carried by the actuator 41, by the variable spacing $h_2$ that is cleared, i.e, uncovered, by the actuator 41.

The actuator 41 is triggered by means of a suitable electronic control unit in which the particular data for the internal combustion engine, such as injection onset, injection duration, injection rate as well as other influencing actuating variables, are stored in memory or into which these data are input. By means of the purposeful electrical triggering of the actuator 41, its length shortens preferably according to a curve of the time and the path distance traversed, so that when the collar 43 of the valve needle 15 strikes the support disk 38 carried by the actuator 41, or afterward, the injection cross section of the injection port 25 is cleared in a correspondingly controlled way, so that an optimal course of injection takes place. Alternatively, the actuator 41 can also be triggered in such a way that at the onset of the injection phase, it is already shortened by a designated, variable amount, so that only the maximal applicable stroke limitation for the valve member 15 is established.

Figure 2:
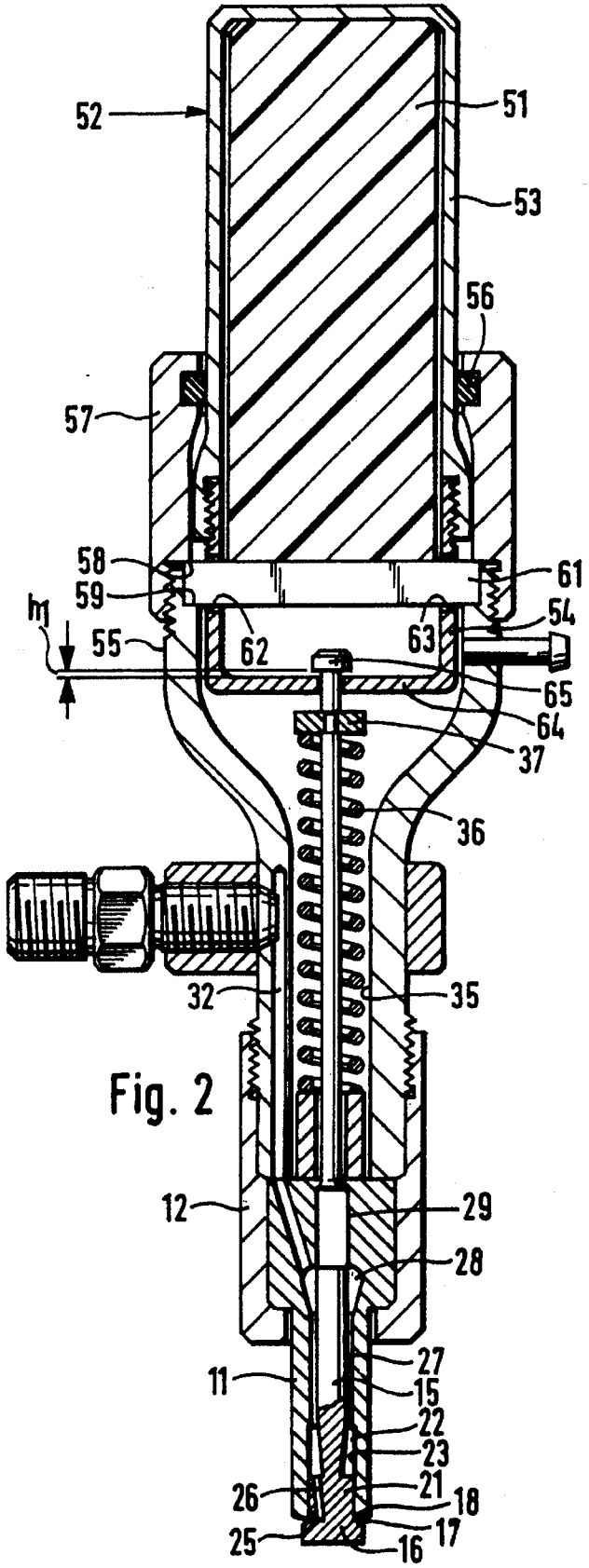

In the exemplary embodiment according to FIG. 1, the actuator 41 is disposed between the closing spring 36 and the closing head 16 of the valve member 15 in the nozzle holder 13. On the other hand, in the exemplary embodiment according to FIG. 2, in which the same elements are provided with the same reference numerals, the actuator 51 is disposed on the end of the nozzle holder 13 opposite the valve member body 15. The actuator 51, which for example is entirely cylindrical in form, preferably a piezoelectric stack, is disposed in a housing 52, which comprises two liners 53, 54 screwed tightly to one another. The housing 52 with the actuator 51 is inserted partway into an extension 55 of the nozzle holder 13 in the longitudinal axis of the valve member 15 so that it can be moved by a slight amount. A union nut 57, which with an offset 58 tightens a bridge 61 against a shoulder 59, guides the housing 52, which is sealed by an O-ring 56. This bridge 61 passes crosswise with play through the one liner 54 in the extension 55, by means of two openings 62, 63, so that the one end of the actuator 51 contacts the bridge 61 and the other end rests in the base of the other liner 53, which protrudes out of the extension 55. The end region of the valve member 15 opposite the closing head 16 passes through the bottom 64 of the one liner 54, which bottom forms a yoke, and on this end has a collar 65 in the free, hollow space that is situated on this side of the liner 54.

In the closing position of the valve member 15, that is, when the closing spring 36 has pulled the closing cone 17 sealingly against the valve seat 18 on the nozzle body 11, the collar 65 of the valve member 15 is spaced apart from the bottom 64 of the one liner 54 by a distance $h_1$ which corresponds to a portion of the stroke of the valve needle 15 that, as in the exemplary embodiment of FIG. 1 described above, is traversed upon opening of the valve member 15 counter to the force of the closing spring 36. The second portion of the stroke of the valve member 15 is determined in a similar manner to that in the exemplary embodiment according to FIG. 1, but by means of the shortening of the length of the actuator 51; the housing 52 is moved axially with the bottom 64, which constitutes the stop for the collar 65 of the valve member 15.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection nozzle for internal combustion engines, particularly diesel engines, having a nozzle body, which has a valve seat, the nozzle body includes a movable valve member having a valve end which controls a metering cross section and which works together with the valve seat, the valve member is acted upon in an opening direction by fuel pressure for an opening stroke and in a closing direction by a closing spring for a closing stroke, an electrically triggered actuator varies the applicable opening stroke of the valve member, said electrically triggered actuator is triggered by an electronic control unit adapted to engine characteristics, a limiting stop (38, 64) surrounds a portion of said valve member, said limiting stop is adjusted by the electrically triggered actuator (41, 51) and controls the reciprocating motion of the valve member, said limiting stop is disposed in an opening stroke path of the valve member (15) effected by hydraulic pressure acting counter to an action of the closing spring and said limiting stop functions in cooperation with a support means on said valve member.

2. The fuel injection nozzle according to claim 1, in which during the opening stroke the valve member (15) comes into contact with the stop (38, 64) only after traversal of a first stroke portion ($h_1$) and afterward is guided by this stop during an ensuing opening stroke portion ($h_2$).

3. The fuel injection nozzle according to claim 1, in which the actuator (41) surrounds the valve member (15) and carries the stop (38), with which a support collar (43) disposed on the valve member (15) comes into contact.

4. The fuel injection nozzle according to claim 2, in which the actuator (41) surrounds the valve member (15) and carries the stop (38), with which a support collar (43) disposed on the valve member (15) comes into contact.

5. The fuel injection nozzle according to claim 1, in which the actuator (51) is connected with an end of the valve member (15) opposite the valve region end, and carries a stop (64) with which a head (65) on an end of the valve member (15) comes into contact.

6. The fuel injection nozzle according to claim 2, in which the actuator (51) is connected with an end of the valve member (15) opposite the valve region end, and carries a stop (64) with which a head (65) on an end of the valve member (15) comes into contact.

* * * * *